United States Patent [19]

Shannon

[11] 4,440,596

[45] Apr. 3, 1984

[54] CONTROL OF DIAMETER OF FIBER INSULATION ON CONDUCTORS

[75] Inventor: Michael A. Shannon, Glenburnie, Canada

[73] Assignee: Northern Telecom Limited, Montreal, Canada

[21] Appl. No.: 380,612

[22] Filed: May 21, 1982

[51] Int. Cl.[3] ..... E04C 1/62

[52] U.S. Cl. ..... 162/106; 162/198; 162/259; 162/263; 162/268; 162/322; 162/326; 162/327; 162/330; 162/DIG. 11

[58] Field of Search ..... 162/267, 268, 323, 322, 162/325, 326, 327, 328, 334, 263, 330, 198, 259, DIG. 10, DIG. 11; 156/51, 64, 360

[56] References Cited

U.S. PATENT DOCUMENTS

| | | | |
|---|---|---|---|
| 1,154,183 | 9/1915 | Gehrlein | 162/327 |
| 1,765,533 | 6/1930 | Jespersen | 162/106 |
| 1,788,531 | 1/1931 | Little | 162/334 |
| 4,184,913 | 1/1980 | Lynch et al. | 162/268 |
| 4,345,962 | 8/1982 | Cowley et al. | 162/106 |

*Primary Examiner*—Peter Chin

*Attorney, Agent, or Firm*—R. J. Austin

[57] ABSTRACT

Pulp vat apparatus for applying pulp to a plurality of conductors in which a pulp vat has a cylinder mould with axially spaced annular perforate regions, one for each conductor, and the vat is divided by partitions into compartments, one for each perforate region. There is a flow inlet for pulp into each compartment and means to vary the pulp flow rate through each inlet independently of the flow rate through the other inlets whereby the level of pulp in each compartment is variable independently of the other compartments.

7 Claims, 6 Drawing Figures

CONTROL OF DIAMETER OF FIBER INSULATION ON CONDUCTORS

This invention relates to the control of diameter of fiber insulation on conductors and is particularly concerned with such insulation on conductors for use in telecommunications cable.

In one process of insulating conductors, the conductors are fed through a pulp bath and after drying of the water from the pulp, a paper fiber insulation results surrounding the conductors. In practice, a plurality of conductors are fed in spaced lateral positions around a cylinder mould disposed within the pulp bath to submerge the conductors as they pass around the mould. The mould is formed upon its peripheral surface with spaced annular perforate regions in which the conductors lie, one to each region, as they pass around the mould. In practice, therefore, the conductors are fed downwardly into the bath, around the cylinder mould, while lying in engagement with a perforate region, and then outwardly around a cylinder mould and a press roll before proceeding further along with the process. While the conductors are submerged in the pulp, the water from the pulp pases through the perforate regions of the cylinder mould, thus causing the pulp fibers to be strained out by the perforate regions so that they become deposited upon the conductors. The conductors surrounded by the pulp move away from the cylinder mould, after passage around the press roll, and the pulp at this stage is in the form of two wings extending outwardly from each side of the pulp. To form the pulp into a substantially cylindrical state of substantially constant diameter around the conductors, the conductors are then moved through a polishing machine which effectively changes the shape of the pulp into that desired. The pulp covered conductors then move through a drying oven to remove substantially all of the remaining moisture and the insulated conductors are then would onto take-up reels.

It has been found in practice that when a plurality of conductors have been coated with pulp insulation in the above fashion, that there can be large variations in pulp diameter upon the conductors. This leads to variations in the electrical characteristics of the insulated conductors such as variation in capacitance or the dielectric constant. One reason for this which has been suggested is that in a case where up to 60 conductors are being insulated with pulp fiber at one time, then a sufficiently wide bath is required to accommodate the conductors in laterally spaced fashion. It is believed with such a width of bath, the flow of the water through the perforate regions differs from one region to another and it is suspected that the flow through the perforate regions varies progressively from the perforate regions around the median plane of the roll towards its axial ends. The result of this obviously is that the pulp fiber applied to the conductors towards the ends of the mould differ substantially from the amount of fiber applied to conductors towards the median plane.

The present invention is concerned with a pulp bath apparatus for applying pulp fiber to conductors in which the diameter of the fiber may be more closely controlled. The invention is also concerned with a method of controlling the diameter of fiber insulation applied to electrical conductors.

Accordingly, the present invention provides a pulp bath apparatus for applying a layer of pulp fiber to conductors comprising a bath, a cylinder mould rotatable within the bath about an axis to move any part of its periphery alternately towards and away from the bottom of the bath, the mould having axially spaced annular perforate regions each for accommodating a conductor as the conductors pass in laterally spaced positions downwardly into the bath, beneath the mould, and upwardly up out of the bath, an outlet for water from within the mould, partition means within the bath extending radially outwards from the cylinder mould in positions between perforate regions to divide the bath into compartments with each perforate region associated solely with one component, flow inlet means for pulp to each compartment, and means to vary the rate of pulp through each inlet means independently of the other inlet means.

The flow inlet means could be in the form of delivery pipes, one for each compartment, and the means to vary the rate of flow culd be in the form of valves located in the delivery pipes. Preferably, however, the apparatus is provided with a pulp reservoir and independently adjustable inlets are provided between the reservoir and the compartments. In an ideal arrangement, the reservoir is disposed alongside the bath and is separated therefrom by a side member of the bath.

In a preferred arrangement, the pulp flow rate varying means comprises a slidable gate for each compartment, the slidable gate being movable across an opening in the side member of the bath to vary the size of the inlet from the reservoir into the compartment. The slidable gate is preferably movable vertically, i.e. as a sluice gate for each operation. In this case, the rate of flow varying means may be a motor, for instance a servo-motor positioned above the gate, and is connected to the gate by a means drivable by the motor to raise and lower the gate.

The apparatus preferably forms part of a fiber diameter control apparatus which also includes a means for measuring the diameter of the fiber insulation surrounding each of the conductors after drying of the fiber and for producing a signal corresponding to the measured diameter, and means to operate the flow rate varying means dependent upon the variant of the produced signal from a datum signal representative of a desired diameter, to raise or lower the level of the pulp in each compartment independently of other compartments and corresponding to a required increase or decrease in the diameter of the fiber towards the desired diameter.

According to the invention also, there is provided a method of controlling the diameter of fiber insulation applied upon each of a plurality of electrical conductors comprising passing the conductors in laterally spaced relationship into a pulp bath, beneath a rotating cylinder mould in the bath and upwardly out from the bath, while locating each conductor within an annular perforate region of the mould and in a bath compartment, separated by a partitiion from other compartments, to deposit fiber in non-cylindrical fashion upon the conductor as water passes through the perforate region and into the mould; forming the fiber into a substantially cylindrical shape, drying the fiber and measuring the diameter of the fiber upon each conductor to provide a signal representative of the diameter; and varying the amount of fiber applied to each conductor in the bath to control the diameter within specified limits by raising or lowering the pulp level in the compartment, independently of levels in other compartments, and thus correspondingly altering the length of path of said insulated conductor in contact with the perforate region of the mould while submerged within the pulp, the pulp level in the compartment being appropriately adjusted by any signal which is representative of the fiber diameter of said conductor and which differs from a datum signal representative of a desired diameter, said differing signal causing the operation of a means to vary the rate of flow of pulp into the compartment.

Embodiments of the invention will now be described, by way of example, with reference to the accompanying drawings, in which.

Figure 1:
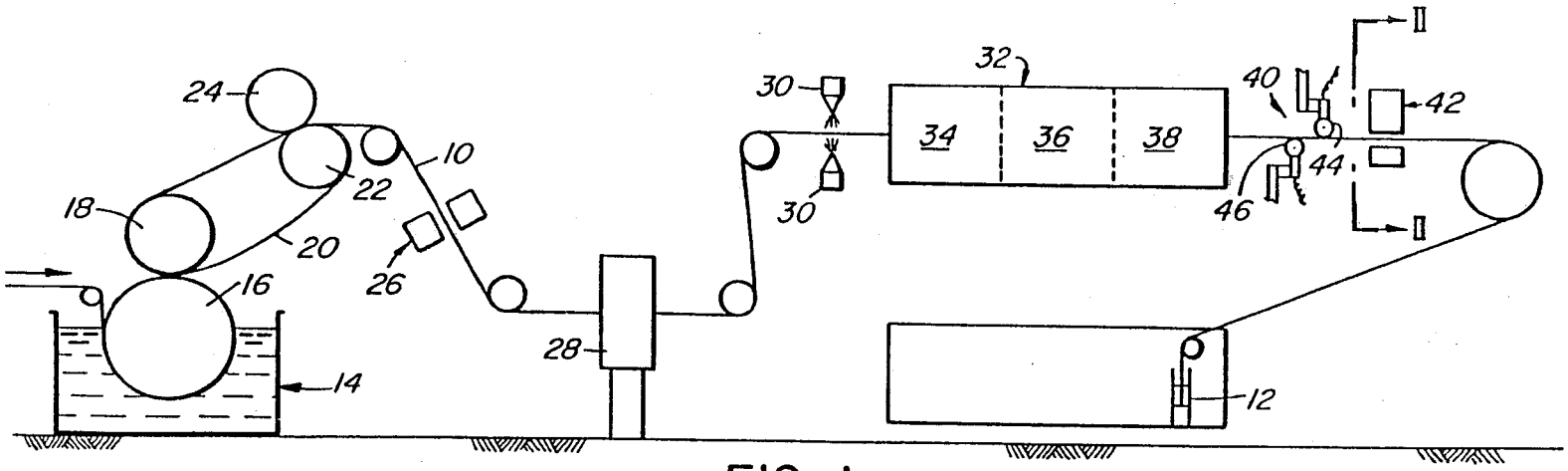
FIG. 1 is a side elevational diagramatic representation of apparatus for applying pulp insulation to electrical conductors.
Figure 3:
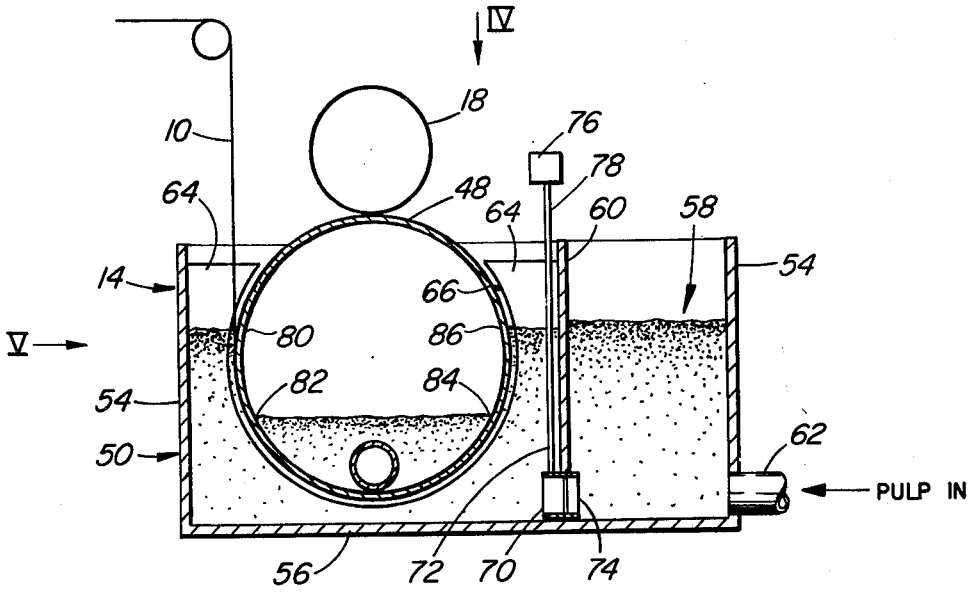
FIG. 3 is a side-elevational cross-sectional view of a pulp bath apparatus forming part of the apparatus of FIG. 1.

As shown in FIG. 1, a plurality of electrical conductors 10, e.g. 60, are drawn by take-up reels 12, side-by-side through a pulp vat or bath apparatus 14, which is the subject of the present invention, and then pass around rolls 16, 18 to submerge the conductors and draw up a continuous coating of pulp onto the conductors as they leave the bath. In FIGS. 1 and 3, only one conductor and take-up reel is shown.

The pulp covered conductors are then drawn upon endless conveyor 20, passing around roll 18 and forming roll 22 which cooperates with a forming roll 24 to press the pulp ribbon into a thin strip with the conductor embedded in it and to remove water from the pulp. From the rolls, the shaped pulp surrounded conductors are passed through weight testing apparatus 26 which is constructed and operates in the manner described in a Canadian patent application filed concurrently with this present application, entitled "Conductor Insulation Weight Testing" in the names of W. E. Cowley and M. A. Shannon and having a priority date of June 25, 1981, the filing date of corresponding United States patent application Ser. No. 277,328.

The apparatus shown in FIG. 1 is further as described in another Canadian patent application filed concurrently with this present application, entitled "Control In Application of Pulp Insulation to Electrical Conductors" in the names of W. E. Cowley and M. A. Shannon, and having a priority date of June 25, 1981, the filing date of corresponding United States patent application Ser. No. 277,327.

As described in the last mentioned application, the pulp covered conductors then proceed through rotating polishers 28 to form the pulp ribbon into a cylinder concentric with the conductor, water sprayers 30, drying oven 32 having three drying zones 34, 36, and 38, a pulp moisture measuring device 40 and a diameter measuring device 42, before reaching the take-up reels 12.

By the use of the moisture measuring device 40 and diameter measuring device 42 and associated control apparatus as described in the aforementioned application entitled "Control in Application of Pulp Insulation to Electrical Conductors", the pulp on each conductor is maintained at an outside diameter which is within preset limits and which, together with the weight measuring apparatus 26, ensures that a controlled finished density of pulp is obtained whereby the mutual capacitance properties between two pulp insulated conductors are maintained at a desired value within preset limits.

The moisture measuring device 40 is constructed similarly to moisture testing apparatus described in U.S. Pat. No. 4,309,654 entitled "Method and Apparatus for Testing Moisture Content of Pulp Insulation During Application Onto An Electrical Conductor", granted Jan. 5, 1982 in the names of M. A. Shannon and W. E. Cowley and will not be described in further detail in this specification. For purposes of this application, it will suffice to say that it comprises upper and lower pulleys 44 and 46 which contact all of the conductors as they pass through. The two pulleys are electrically insulated from their mounting frame (not shown) and the upper pulley 44 is disposed downstream of lower pulley 46. A first voltage source is connected to the upper pulley to provice a first voltage divider as described in the patent entitled "Method and Apparatus For Testing Moisture Content of Pulp Insulation During Application Onto An Electrical Conductor". A second voltage divider is provided by connecting a second voltage to the lower pulley 46. The signals from the two voltage dividers are fed to two high impedance amplifiers (not shown) and from there to a differential amplifier.

The apparatus so far described operates satisfactory and in a general sense to control the diameter of the dried pulp fiber and its density on the conductors. However, this apparatus does not satisfactorily provide uniformity in diameter and density across the sixty conductors from one conductor to another. It has been found that variation may exist in diameter and density progressively increasing or decreasing across the sixty conductors. The reason for this is determined to be caused by the flow characteristics of the pulp in the wide bath 14 in that there is differential flow through the cylinder mould of the mould from one position of the bath to another thereby resulting in differential amounts of pulp fiber being laid onto the conductors in the bath. According to one important aspect of the invention, and as now to be described, the pulp bath apparatus 14 is constructed to assist in overcoming this problem.

Figure 4:
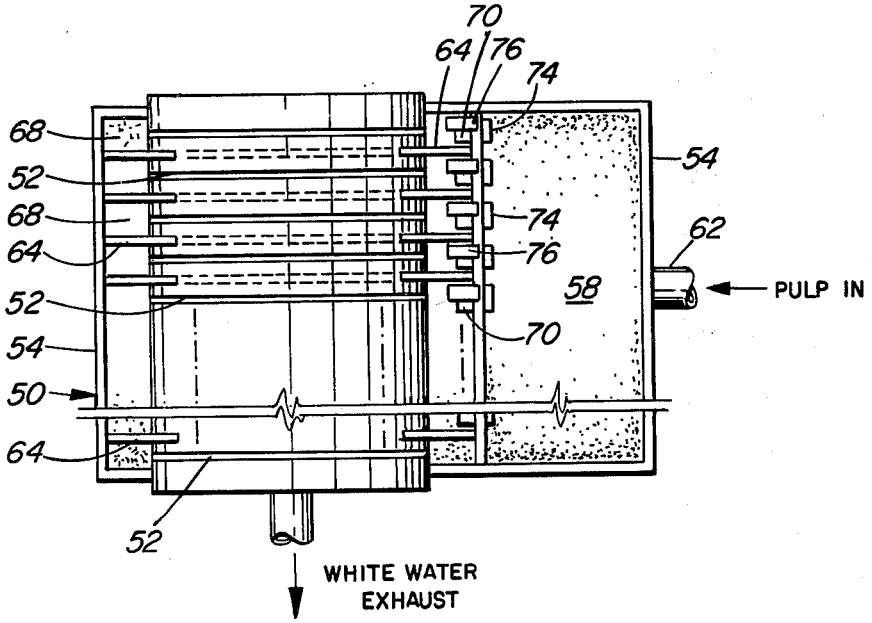
FIG. 4 is a view of part of the pulp bath apparatus of FIG. 3 taken in the direction of arrow 'IV—IV' in FIG. 3.
Figure 5:
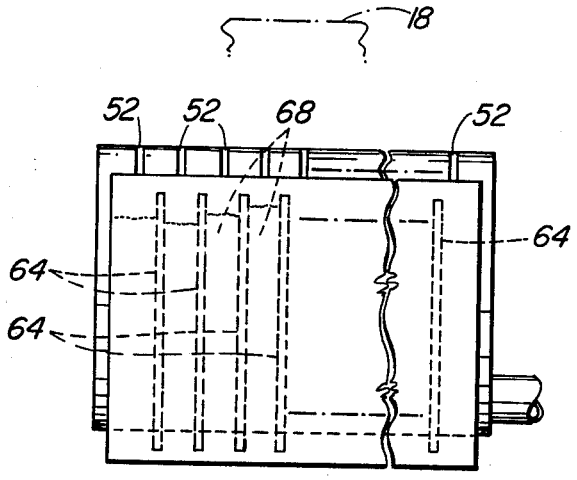
FIG. 5 is an elevational view of part of the pulp bath apparatus taken in the direction of arrow 'V—V' in FIG. 3.

The pulp bath apparatus 14 is shown in greater detail in FIGS. 3, 4 and 5. As shown by FIG. 3, the pulp bath apparatus comprises a cylinder mould 48 rotatably mounted about a horizontal axis with a vat or bath 50. The cylinder mould 48 is of conventional construction in that it has axially spaced annular perforate regions 52 (FIGS. 4 and 5) each region 52 for accommodating an individual conductor 10 as the conductor passes around the cylinder mould, i.e. downwardly into the bath beneath the mould and upwardly out of the bath as shown in FIGS. 1 and 3. These perforate regions operate in conventional fashion to act as filters for pulp fiber in the bath in use by allowing the water to pass through the perforate regions into the interior of the mould while retaining the fiber upon the perforate regions so as to cover the conductors.

The bath 50 is formed by vertical members 54 and a base 56, the members 54 and also defining a pulp reservoir 58 which lies alongside the bath 14 and is separated from it by a divider 60 between bath and reservoir and which extends across the whole structure of sides 54 and common base 56. Pulp is fed into the reservoir through an inlet 62 which is disposed towards the bottom of the reservoir.

The bath 14 is provided with partition means in the form of walls or partitions 64 which extend between the divider 60 and a side member 54 so as to pass beneath the cylinder mould 48. As shown by FIG. 3, each partition 64 extends around the cylinder mould so as to substantially conform to its shape and may provide a gap 66 between the cylinder mould and the partition, the gap possibly being of the order of ⅛". Each partition extends upwardly of the side members and terminates close to the top of the side members as shown. The partition means are disposed within the bath so as to divide the bath into compartments 68 as shown in FIGS. 4 and 5. These compartments are disposed so as to be associated one with each perforate region 52, i.e. each perforate region faces into a single compartment as the cylinder mould rotates.

The bath is provided with a flow inlet means for pulp from the reservoir 58 into each compartment. In the case of each compartment, the flow inlet means comprises a slidable gate in the form of a sluice gate 70 which is held by guides (not shown) to the side member 60 whereby it is movable vertically to open and close an opening 74 between the reservoir and the pulp bath.

Means is also provided to vary the rate of flow of pulp through the reservoir to each of the compartments 68.

The means to vary the rate of flow of pulp to each compartment comprises a servo-motor 76 which is disposed vertically above its associated gate 70 at the side member 60. Each motor 76 is connected to its gate 70 by a driving means which comprises a rotatable driving spindle 78 which extends vertically down the side of the side member 60 inside its respective compartment 68 and the lower end of the spindle 78 is screw-fitted and received within a corresponding nut (not shown) which is attached to the gate 70. Upon rotation of the spindle 78, therefore, in the appropriate direction, the gate 70 is caused to move vertically either upwards or downwards.

By the use of the partition means, the height of pulp in each compartment may be different from the height in other compartments. The small gap formed by a low friction bladder seal (not shown) between the cylinder mould and each partition 64 allows a negligible amount of pulp to flow through so that there is no substantial levelling effect of the pulp between the compartments. The amount of pulp fiber which is applied to each conductor is dependent not only upon the time that the conductor is immersed in the pulp in contact with the cylinder mould but also depends upon the difference in heights between the pulp in the bath and the ongoing water in the cylinder mould. In other words, fiber is only applied to the conductor on the ingoing side between position 80, as shown in FIG. 3, at which the conductor first contacts the mould beneath the surface of the pulp, and position 82 which is at the level of the water inside the mould. On the outgoing side of the bath, the fiber accummulates on the conductor between position 84 on the mould at which the mould moves away from the level of the water inside it, and position 86 at which the conductor either moves out of engagement with the perforate region or leaves the pulp. It is clear, therefore, that if the level of the pulp within each compartment is raised or lowered, then the distance around the cylinder mould at which the fiber can accummulate on each conductor is also varied and this leads to a variation in the amount of fiber added to the conductor. In other words, if the pulp is high in a compartment, then the amount of fiber added to the conductor will be more than if the pulp is at a lower position. Hence, if the level of the pulp in any compartment is caused to change to alter the amount of fiber on its associated conductor to bring that amount towards a desired level, then this will have no effect upon the amount of fiber being added to other conductors.

Figure 2:
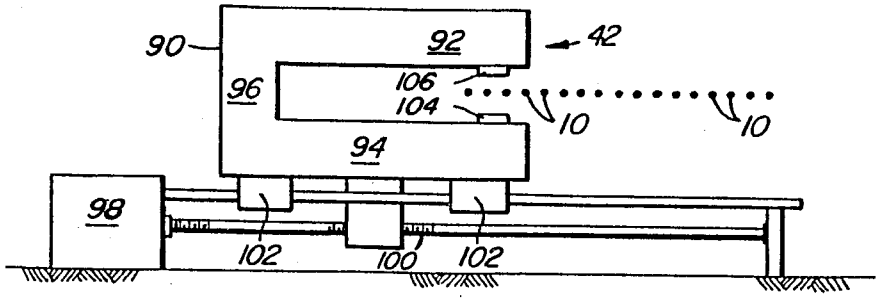
FIG. 2 is a cross-sectional view taken along 'II—II' in FIG. 1 showing pulp covered core being passed through a diameter measuring device.

An object of the invention is to provide a method of individually controlling the diameter of pulp fiber insulation upon each of the conductors being fed through the apparatus and as may be seen, this is made possible by controlling the amount of fiber applied to each conductor individually with the bath described above. Of course, some control is required upon the degree of opening of the gate for each compartment to control the level of the pulp in that compartment whereby the diameter of the final insulation is as desired. This control is provided by the diameter measuring device 42 (FIG. 2) which is provided downstream of the moisture measuring device 40.

The diameter measuring device 42 comprises a radiation scanning device 90 having two arms 92 and 94 for movement above and below the passline of the conductors 10, the arms being jointed at one end by a vertical base 96. A reversible drive motor 98 is connected to the device 90 by a drive screw 100 and sliding guides 102 hold the device 90 correctly in position as it travels laterally of the conductors.

The device 90 comprises a laser radiation emitter 104 mounted at the free end of the lower arm 94, the emitter being directed across the passline. A radiation detector 106 is mounted in line with the emitter at the free end of the upper arm 92.

In use, the device 90 moves from left to right intermittently across the passline and stops each time the emitter 104 and detector 106 are disposed correctly in position on each side of a conductor. After the device has been in position sufficiently long, e.g. about 8 seconds, for the detector to have obtained a light signal from the emitter which corresponds to the diameter of the conductor, the motor 98 is energized by a microprocessor 108 (FIG. 6) to move the device 90 to bring the emitter and detector into positions above the next succeeding conductor.

Figure 6:
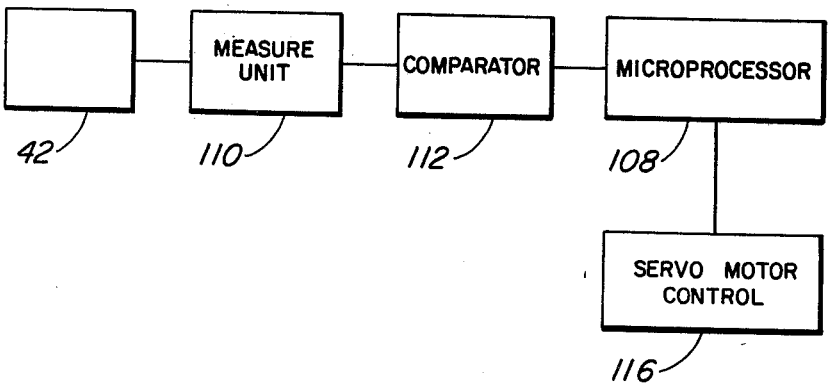
FIG. 6 shows a control block diagram according to the invention.

As shon by the control block diagram in FIG. 6, signals from the measuring device 42 are digital control signals which are sent to a measuring unit 110. These signals which correspond to the diameter of each insulated conductor, are sent as digital signals to a digital analog comparator 112 which compare the digital value with a datum value which corresponds to the actual desired diameter of the insulated conductor. An analog voltage is then produced which corresponds to the magnitude of the difference between the measured value and that of the datum value representing the desired diameter of insulated conductor. The analog voltage is then transmitted to the microprocessor. Dependent upon whether the digital signal received from the measuring unit 110 is above or below the datum signal for the desired diameter, then the microprocessor controls the operation of the corresponding servo-motor for a particular conductor through the servo-motor control 116 to open or close its sluice gate 70 appropriately to increase or decrease the rate of flow of pulp and hence to raise or lower the pulp with the object of increasing or decreasing the fiber on the conductor to move the actual diameter towards that desired.

In use of the apparatus, as the plurality of conductors pass through the pulp bath, i.e. each through its own compartment and around its own perforated region 52, the diameter measuring device 42 measures the diameter of the insulation individually one each conductor after the insulation has been dried in the oven 32. When the microprocessor receives an analog voltage from the comparator 112, thus indicating that there is a difference between the actual diameter of the dried pulp and the desired diameter, the it sends a control message to the servo-motor control 116 for operating the motor 76 associated with the compartment of the conductor which has been measured. The sluice gate 70 is then moved appropriately to increase or decrease the flow of pulp from the reservoir 58 into the associated compartment 68, whereby the level of the pulp in the compartment is raised or lowered appropriately to increase or decrease the path along which fiber is laid into the conductor. Hence the amount of fiber applied to each conductor may be controlled and varied with the object of providing a finished diameter of dried pulp which approximates the desired diameter of the insulation. It is important to note with this apparatus that the insulation diameter may be adjusted upon each conductor individually without affecting the diameter of insulation upon other conductors. This apparatus compared favourably with conventional apparatus in which all of the conductors pass through a single compartmented pulp bath whereby any variation in the height of the pulp in the bath affects the amount of fiber and therefore the diameter of all of the conductors at the same time. With such a conventional apparatus, there can be no control over the amount of fiber applied to each conductor. As the amount of fiber, and thus the final diameter of the insulation upon conductors is dependent upon the flow of the pulp through the bath and through the perforate regions in a conventional construction, then the height of pulp in a conventional bath can not possibly be used to control the diameter of insulation on each conductor individually.

What is claimed is:

1. A pulp vat apparatus for applying a layer of pulp fiber to conductors comprising a vat, a cylinder mould rotatable within the vat about an axis to move any part of its periphery alternately towards and away from the bottom of the vat, the mould having axially spaced annular perforate regions each for accommodating a conductor as the conductors pass in laterally spaced positions downwardly into the vat beneath the mould and upwardly out of the vat, an outlet for water from within the mould, partition means within the vat extending radially outwards from the cylinder mould in positions between perforate regions to divide the vat into compartments with each perforate region associated solely with one compartment, flow inlet means for pulp to each compartment, means to vary the rate of flow of pulp through each inlet means independently of the other inlet means, means for guiding a plurality of electrical conductors through the vat in laterally spaced positins along the annular perforate regions of the mould, means for measuring the diameter of the fiber insulation surrounding each of the conductors after drying of the fiber and for producing a signal corresponding to the measured diameter, and means to operate the flow rate varying means depending upon the variation of the produced signal from a datum signal representative of a desired diameter, to raise or lower the level of the pulp in each compartment independently of other compartments and corresponding to a required increase or decrease in the diameter of the fiber towards the desired diameter.

2. Apparatus according to claim 1, wherein each inlet means has an independently adjustable inlet and the means to vary the rate of flow varies the effective size of the inlet.

3. Apparatus according to claim 2, wherein a pulp reservoir is disposed alongside the vat and is separated therefrom by a side member or dividing member and each inlet is a size controlled opening in the dividing member and which interconnects the reservoir and the vat.

4. Apparatus according to claim 3, wherein the pulp flow rate varying means for each compartment comprises a gate slidable upon the divider member to vary the size of the opening.

5. Apparatus according to claim 4, wherein each gate is movable vertically.

6. Apparatus according to claim 5, wherein the flow varying means comprises a motor positioned above each gate and connected thereto by a means drivable by the motor to raise and lower the gate.

7. A method of controlling the diameter of fiber insulation appllied upon each of a plurality of electrical conductors comprising passing the conductors in laterally spaced relationship into a pulp vat, beneath a rotating cylinder mould in the bath and upwardly out of the vat, while locating each conductor within an annular perforate region of the mould and in a vat compartment, separated by a partition from other compartments, to deposit fiber in non-cylindrical fashion upon the conductor as water passes through the perforate region and into the mould, forming the fiber into a substantially cylindrical shape, drying the fiber and measuring the diameter of the fiber upon each conductor to generate a signal representative of the diameter, and varying the amount of fiber applied to each conductor in the vat to control the diameter within specified limits by adjusting the pulp level in its associated compartment, independently of levels in other compartments, by activating a means to vary the flow rate into the compartment in response to the signal generated, and thus correspondingly altering the length of path of said conductor in contact with the perforate region of the mould while submerged within the pulp, the pulp level in the compartment being appropriately adjusted by any signal which is representative of the fiber diameter of said conductor and which differs from a datum signal representative of a desired diameter, said differing signal causing the operation of the means to vary the rate of flow of pulp into the compartment.

* * * * *